United States Patent [19]

Palmer

[11] 4,082,332

[45] Apr. 4, 1978

[54] SECURITY APPARATUS

[76] Inventor: Wayne D. Palmer, 5622 Faulconbridge Rd., Charlotte, N.C. 28212

[21] Appl. No.: 762,855

[22] Filed: Jan. 27, 1977

[51] Int. Cl.[2] ..... E05C 19/00

[52] U.S. Cl. ..... 292/259 R

[58] Field of Search ..... 292/259, DIG. 19, 260, 292/262, DIG. 46

[56] References Cited

U.S. PATENT DOCUMENTS

| | | | |
|---|---|---|---|
| 521,870 | 6/1894 | Smith | 292/259 |
| 1,280,048 | 9/1918 | Lavender | 292/DIG. 19 |
| 1,533,687 | 4/1925 | Beck et al. | 292/DIG. 19 |
| 3,980,328 | 9/1976 | Pearson | 292/259 R |

*Primary Examiner*—Richard E. Moore

*Attorney, Agent, or Firm*—Bell, Seltzer, Park & Gibson

[57] ABSTRACT

A security apparatus adapted to prevent the opening of a door by intruders and which comprises an elongate rigid bar, and a pair of brackets for selectively mounting the bar across the door opening. The bar carries a hollow cylinder of resilient foam material or the like which is adapted to contact the door to thereby cushion the shock of the door being forceably opened against the bar to thereby minimize damage to the door and reduce the possibility of the mounting brackets being released from the wall. In the preferred embodiment, means are provided for insuring that the resilient cylinder is positioned to overlie the doorknob side of the door, and means may also be provided for hanging the bar from one of the brackets in a non-operative position.

7 Claims, 6 Drawing Figures

SECURITY APPARATUS

The present invention relates to a security apparatus for overlying a door or the like to prevent the forceable opening thereof by intruders.

Various security devices have heretofore been proposed for precluding the forceable opening of a door. For example, the patent to Howard, U.S. Pat. No. 3,280,606 discloses a tubular metal crossbar which is adapted to extend through screw-eyes mounted in the wall on each side of the door opening. The patent to Craig, U.S. Pat. No. 3,809,417 illustrates a similar device, wherein a crossbar is mounted between a ring on one side of the door frame and a pin on the opposite side.

Prior security devices of the above type suffer from a series deficiency however, in that such devices permit the door to be opened slightly before contacting the transverse bar, thereby permitting the door to be forceably battered against the bar. As will be readily understood, such battering can quickly destroy the door, particularly in the case of lightweight, hollow doors of the type now widely used in home construction. Also, such repeated battering can result in the impact release of the holding brackets or eyelets along the sides of the door.

It is accordingly an object of the present invention to provide a security apparatus of the described type and which is adapted to both minimize the damage to the door and resist the release of the mounting brackets upon an attempted battering of the door against the transverse bar.

It is a more particular object of the present invention to provide a security apparatus of the described type which includes resilient cushioning means between the door and transverse bar, such that the shock of an attempted battering of the door against the bar is absorbed and dissipated.

It is another object of the present invention to provide means for insuring that the resilient cushioning means is positioned to overlie the doorknob side of the door when the bar is operatively positioned between the brackets, to thereby most effectively cushion the movement of the door against the bar.

These and other objects and advantages of the present invention are achieved in the embodiment illustrated herein by the provision of a security apparatus which comprises an elongate rigid bar, and a pair of brackets which are adapted to be mounted to the wall along the sides of the door opening. The brackets are each configured to permit the bar to be selectively secured thereto, and such that the bar may be mounted to extend between the brackets and across the door opening. Resilient means, which preferably comprises a cylinder of foam plastic material, is carried by the bar and extends radially outwardly therefrom so as to be adapted to at least closely approach the surface of the door when the bar is mounted between the brackets. By this arrangement, the resilient means serves to cushion the shock of the door being forceably opened against the bar to thereby minimize damage to the door and reduce the possibility of the brackets being released upon the forceable battering of the door against the bar.

In the preferred embodiment of the invention as illustrated herein, one of the brackets is in the form of a substantially closed loop of generally rectangular cross-sectional outline, while the other bracket has a generally J-shaped cross-sectional outline. Thus to mount the bar between the brackets, one end of the bar is inserted through the loop of the first bracket, and the other end of the bar is then lowered onto the J-shaped bracket. An abutment is carried at the other end of the bar to preclude the same from passing through the loop of the first bracket, whereby the bar may be mounted between the brackets in only one orientation, thereby insuring that the resilient means is positioned to overlie the doorknob side of the door. Also, the other end of the bar may include a laterally directed extension for hanging the bar from the other bracket in a non-operative storage position.

Some of the objects of the invention having been stated, other objects will appear as the description proceeds, when taken in connection with the accompanying drawings, in which FIG. 1 is a fragmentary perspective view illustrating a security apparatus embodying the features of the present invention and showing the same in its operative position across a door opening;

Figure 1:
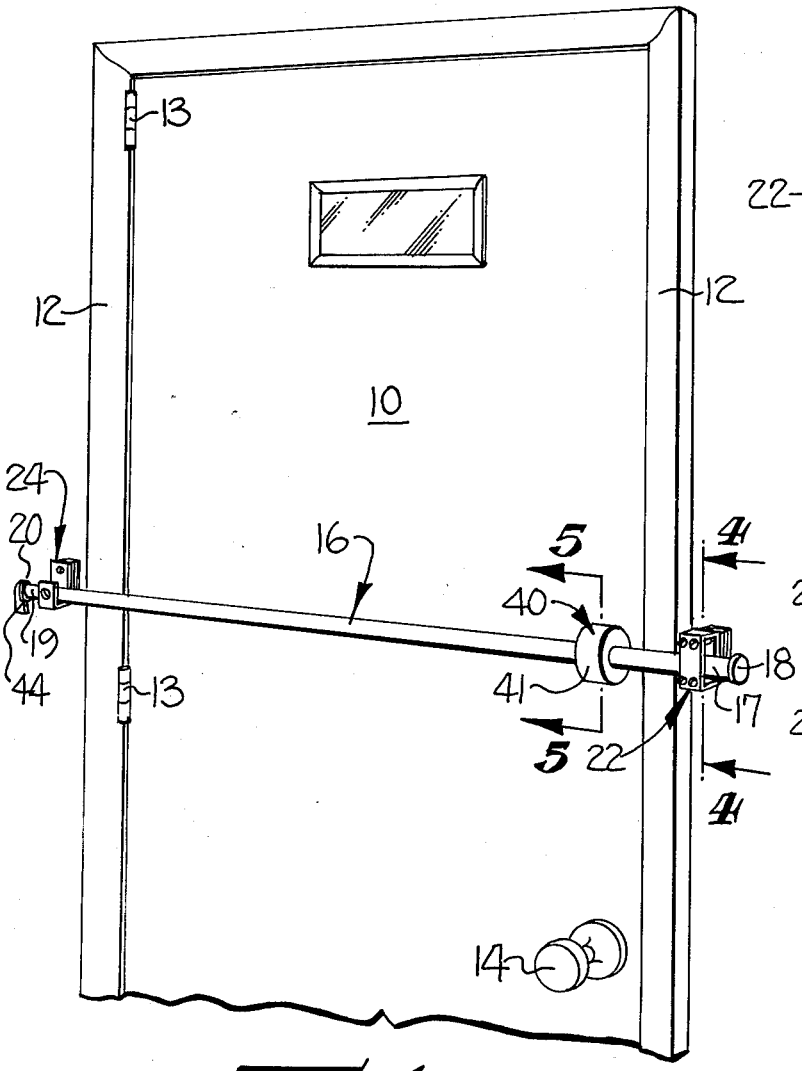

Referring more specifically to the drawings, FIG. 1 illustrates a conventional door opening comprising the door 10, frame 12, hinges 13, and doorknob 14. To prevent the door from being forceably opened, there is provided in accordance with the present invention an elongate rigid bar 16 having a length sufficient to extent transversely across and beyond the door opening as defined by the frame 12. The bar 16 is fabricated from a relatively high strength material, such as tubular steel, and one end 17 thereof is closed by means of a plastic end cap 18 or the like. The other end 19 is closed by a plastic end cap 20 which forms an abutment as hereinafter further described.

A pair of metal brackets 22, 24 are provided for selectively mounting the bar in its operative position as shown in FIG. 1. More particularly, one bracket 22 is in the form of a substantially closed loop of generally rectangular cross-sectional outline and comprises a relatively flat inner portion 26 adapted to be positioned against a supporting wall surface, and a relatively flat outer portion 27 which is parallel to and spaced from the inner portion. The other bracket 24 has a generally J-shaped cross-sectional outline and comprises a generally flat inner portion 28 adapted to be positioned against the supporting wall surface and a generally flat outer flange 29 which is parallel to and spaced from the inner portion 28.

Figure 2:
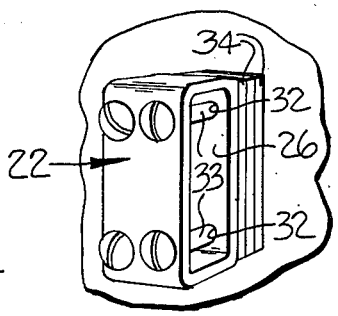
FIG. 2 is a fragmentary perspective view of one of the mounting brackets of the present invention.
Figure 3:
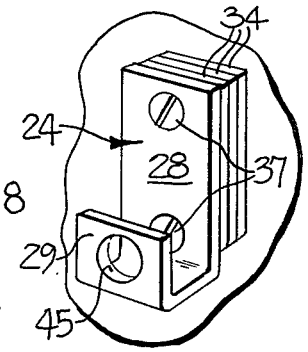
FIG. 3 is a perspective view of the other mounting bracket of the present invention.
Figure 4:
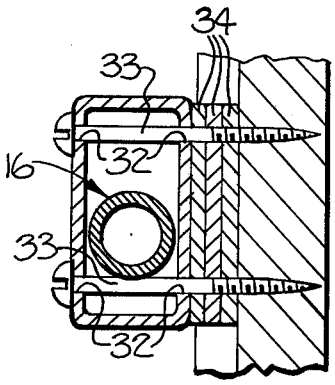
FIG. 4 is a sectional side elevation view taken substantially along the line 4—4 of FIG. 1.

The two brackets 22 and 24 each include means for mounting the same to the wall along the sides of the door opening and in horizontal alignment with respect to each other. In the case of the bracket 22, this mounting means comprises a total of four apertures 32 extending through both the inner portion 26 and outer portion 27 thereof, and a threaded member 33 adapted to extend through each of these apertures and into the wall. In order to insure that the bar 16 may be mounted to clear the door frame 12, a number of shims 34 may be positioned between the inner portion 26 and wall in the manner shown in FIG. 2. The means for mounting the bracket 24 comprises a pair of apertures 36 in the inner portion 28 and cooperating threaded members 37.

Each bracket 22 and 24 further comprises means for selectively securing the bar 16 to the bracket when the brackets are mounted on opposite sides of the door opening and such that the bar may be selectively mounted to extend between the brackets and across the door opening. In the case of the bracket 22, this securing means comprises the spacing between the inner portion 26 and outer portion 27 whereby the end 17 of the bar 16 is adapted to be received therebetween by inserting the end 17 into and through the loop of the bracket. In the case of the bracket 24, this securing means comprises the spacing between the inner portion 28 and flange 29 whereby the end 19 of the bar is adapted to be lowered between the inner portion 28 and flange 29 after the end 17 has been received within the closed loop of the bracket 22.

Figure 5:
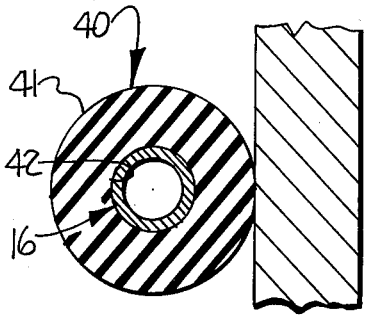
FIG. 5 is a sectional side elevation view taken substantially along the line 5—5 of FIG. 1.

The security apparatus of the present invention further comprises resilient means 40 carried by the bar 16 and extending radially outwardly therefrom so as to be adapted to at least closely approach the surface of the door 10 when the bar 16 is mounted between the brackets, note FIG. 5. In the preferred embodiment, the resilient means comprises a right circular cylinder 41 having an opening 42 extending coaxially therethrough, and with the bar 16 extending through the opening. The cylinder 41 is preferably fabricated from a relatively dense foam plastic material or the like. Thus upon any attempted forceable opening of the door 10, the resilient cylinder 41 will serve to cushion the shock of the door being opened against the bar to thereby minimize damage to the door and reduce the possibility of the brackets 22, 24 being released from the wall.

In order to achieve maximum efficiency from the resilient cylinder 41, it is desirable that the cylinder be positioned on the bar 16 at a point adapted to overlie the doorknob side of the door 10 when the bar is mounted between the brackets in its operative position. To insure such orientation, the cylinder 41 may be adhered to the bar 16 by an adhesive or the like at a point spaced a short distance from the end 17, and the abutment 20 is of a size to preclude the same from passing through the closed loop of the bracket 22. Thus the bar 16 can be mounted between the brackets in only one orientation, and the resilient cylinder 41 will necessarily be positioned to overlie the doorknob side of the door.

To provide a convenient arrangement for storing the bar 16 in a non-operative position, means may be provided for releasably attaching the end 19 of the bar to the outer flange 29 of the bracket 24, and with the bar depending vertically downwardly from the bracket. In the illustrated embodiment, this releasable attaching means comprises a laterally directed extension 44 which forms an integral part of the abutment 20, and a cooperating aperture 45 in the outer flange 29 which is adapted to receive the extension 44 therein in the manner shown in FIG. 6.

Figure 6:
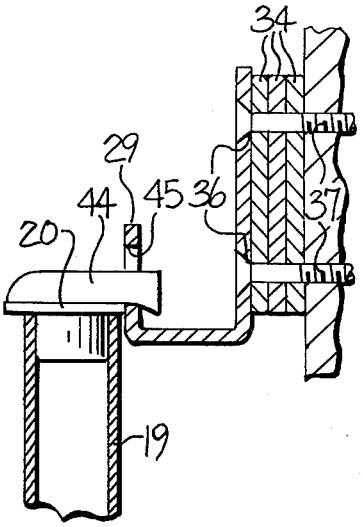
FIG. 6 is a sectional side elevation view taken through the bracket shown in FIG. 3 and further illustrating the means for releasably attaching the bar to the bracket in a downwardly depending, non-operative, storage position.

In use, the bar 16 is initially removed from its storage position as shown in FIG. 6 by withdrawing the extension 44 from the aperture 45. The end 17 is then inserted through the loop of the bracket 22, and the end 19 is lowered between the inner portion 28 and flange 29 of the J-shaped bracket 24. The bar 16 is thereby securely held in its operative position to preclude an attempted forceable entry. Should the door 10 be battered against the bar as part of an attempted forceable entry, the shock of the door striking the bar will be absorbed and dissipated by the resilient cylinder 41 to thereby minimize the damage to the door and resist the release of the brackets 22, 24 from the wall.

To return the bar 16 to its non-operative storage position, the bar is merely lifted from the bracket 24 and the end 17 is withdrawn from the bracket 22. The extension 44 of the abutment 20 is then inserted into the aperture 45 to support the bar in a downwardly depending position along the hinged side of the door, note FIG. 6.

In the drawings and specification, there has been set forth a preferred embodiment of the invention, and although specific terms are employed, they are used in a generic and descriptive sense only and not for purposes of limitation.

That which is claimed is:

1. A security apparatus for overlying a door or the like to prevent the opening thereof by intruders, and characterized by the ability to minimize damage to the door and resist the release of the apparatus upon a forceable battering of the door against the apparatus, and comprising an elongate rigid bar having a length sufficient to extend transversely across and beyond the door opening, a pair of brackets, with each bracket having means for mounting the same to the wall along the side of the door opening, and means for selectively securing the bar to such bracket when the brackets are mounted on opposite sides of the door opening such that the bar may be selectively mounted to extend between the brackets and across the door opening, one of said brackets being in the form of a substantially closed loop of generally rectangular cross-sectional outline and comprising an inner portion adapted to be positioned against a supporting wall surface and an outer portion which is parallel to and spaced from said inner portion, the other of said brackets having a generally J-shaped cross-sectional outline and comprising an inner portion adapted to be positioned against a supporting wall suface and an outer flange which is parallel to and spaced from said inner portion, said means for securing the bar to said one bracket comprising the spacing between said inner and outer portions whereby one end of the bar is adapted to be received therebetween and said means for securing the bar to said other bracket comprising the spacing between said inner portion and flange whereby the other end of said bar is adapted to be lowered between said inner portion and flange of said other bracket after said one end of the bar has been received within the closed loop of said one bracket, said other end of said bar including abutment means of a size to preclude the same from passing through the closed loop of said one bracket, whereby the bar may be mounted between the brackets in only one orientation, and resilient means carried by said bar and extending radially outwardly therefrom so as to be adapted to at least closely approach the surface of the door when the bar is mounted between the brackets, and whereby the resilient means serves to cushion the shock of the door being forceably opened against the bar to thereby minimize damage to the door and reduce the possibility of said bracket mounting means being released upon the forceable battering of the door against the bar.

2. A security apparatus for overlying a door or the like to prevent the opening thereof by intruders, and characterized by the ability to minimize damage to the door and resist the release of the apparatus upon a forceable battering of the door against the apparatus, and comprising an elongate rigid bar having a length sufficient to extend transversely across and beyond the door opening, a pair of brackets, with each bracket having means for mounting the same to the wall along the side of the door opening, and means for selectively securing the bar to such bracket when the brackets are mounted on opposite sides of the door opening such that the bar may be selectively mounted to extend between the brackets and across the door opening, and a right circular cylindrical resilient means having an opening extending coaxially therethrough, said bar extending through said opening and said resilient means extending radially outwardly therefrom so as to be adapted to at least closely approach the surface of the door when the bar is mounted between the brackets, and whereby the resilient means serves to cushion the shock of the door being forceably opened against the bar to thereby minimize damage to the door and reduce the possibility of said bracket mounting means being released upon the forceable battering of the door against the bar.

3. The security apparatus as defined in claim 1 wherein said resilient means further comprises a foam plastic material.

4. The security apparatus as defined in claim 1 wherein said resilient means is positioned on said bar at a point adapted to overlie the doorknob side of the door when the bar is mounted between said brackets in said one orientation.

5. The security apparatus as defined in claim 4 further comprising means for releasably attaching said other end of said bar to said outer flange of said other bracket with the bar depending vertically downwardly from said other bracket to thereby provide a convenient hanger for retaining the bar in a non-operative position.

6. The security apparatus as defined in claim 5 wherein said means for releasably attaching said other end of said bar to said other bracket comprises a laterally directed extension on said abutment means, and an aperture in said outer flange for receiving said extension therein.

7. The security apparatus as defined in claim 6 wherein said means for mounting said brackets to the wall along the sides of the door opening comprises a plurality of apertures extending through each bracket, and a threaded member adapted to extend through each aperture and into the wall.

* * * * *

UNITED STATES PATENT AND TRADEMARK OFFICE

CERTIFICATE OF CORRECTION

PATENT NO. : 4,082,332

DATED : April 4, 1978

INVENTOR(S) : Wayne D. Palmer

It is certified that error appears in the above-identified patent and that said Letters Patent are hereby corrected as shown below:

Column 4, Line 21 delete "1." and insert therefor - 3. -;

Column 5, Line 7 delete "2." and insert therefor -1. -;

Column 6, Line 8 delete "1" and insert therefor - 3 -.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*